US011564023B2

(12) United States Patent
Guo et al.

(10) Patent No.: US 11,564,023 B2
(45) Date of Patent: Jan. 24, 2023

(54) DISPLAY APPARATUS AND ELECTROMAGNETIC ACTUATOR

(71) Applicant: HISENSE VISUAL TECHNOLOGY CO., LTD., Qingdao (CN)

(72) Inventors: Fuxin Guo, Qingdao (CN); Haiying Wang, Qingdao (CN)

(73) Assignee: HISENSE VISUAL TECHNOLOGY CO., LTD., Qingdao (CN)

( * ) Notice: Subject to any disclaimer, the term of this patent is extended or adjusted under 35 U.S.C. 154(b) by 0 days.

(21) Appl. No.: 17/235,734

(22) Filed: Apr. 20, 2021

(65) Prior Publication Data

US 2021/0243511 A1 Aug. 5, 2021

Related U.S. Application Data

(63) Continuation of application No. PCT/CN2020/096671, filed on Jun. 17, 2020.

(30) Foreign Application Priority Data

Jun. 17, 2019 (CN) ..... 201910523147.1

(51) Int. Cl.
*H04R 9/06* (2006.01)
*H04R 1/02* (2006.01)
(Continued)

(52) U.S. Cl.
CPC ..... *H04R 1/028* (2013.01); *H04R 7/045* (2013.01); *H04R 9/02* (2013.01); *H04R 9/06* (2013.01);
(Continued)

(58) Field of Classification Search
CPC ..... H04R 1/028; H04R 7/045; H04R 7/06; H04R 9/02; H04R 9/06; H04R 9/066;
(Continued)

(56) References Cited

U.S. PATENT DOCUMENTS 5,025,474 A * 6/1991 Tanaka ..... H04R 1/02 381/349
6,332,029 B1 * 12/2001 Azima ..... H04R 1/021 381/337
(Continued)

FOREIGN PATENT DOCUMENTS

CN 203661283 U 11/2004
CN 201623850 U 11/2010
(Continued)

OTHER PUBLICATIONS

ISR of PCTCN2020096670.
(Continued)

*Primary Examiner* — Huyen D Le
(74) *Attorney, Agent, or Firm* — J.C. Patents

(57) ABSTRACT

Embodiments of the present disclosure provide a display apparatus and an electromagnetic actuator, the display apparatus includes a display structure, a sound-emitting substrate, at least one electromagnetic actuator and a stabilizer; where one side of the sound-emitting substrate is attached to the display structure, and the electromagnetic actuator is fixedly attached to the other side of the sound-emitting substrate through the stabilizer; the electromagnetic actuator includes a bracket and a plurality of flexible support feet extending away from the bracket. The electromagnetic actuator is fixedly arranged on the sound-emitting substrate through the stabilizer, and the bracket receives the electromagnetic actuator, the plurality of flexible support feet can keep the electromagnetic actuator stable during the vibration process of the electromagnetic actuator, which helps avoid position shift of the electromagnetic actuator under long-time working.

19 Claims, 12 Drawing Sheets

(51) Int. Cl.
*H04R 9/02* (2006.01)
*H04R 7/04* (2006.01)

(52) U.S. Cl.
CPC ..... *H04R 9/066* (2013.01); *H04R 2400/03* (2013.01); *H04R 2440/05* (2013.01); *H04R 2499/15* (2013.01)

(58) Field of Classification Search
CPC ..... H04R 11/02; H04R 2307/021; H04R 2307/027; H04R 2400/03; H04R 2440/05; H04R 2499/15
See application file for complete search history.

(56) References Cited

U.S. PATENT DOCUMENTS

| | | | | |
|---|---|---|---|---|
| 6,618,487 | B1 * | 9/2003 | Azima | H04R 5/02 381/396 |
| 7,151,837 | B2 * | 12/2006 | Bank | H04R 7/045 381/431 |
| 2003/0081799 | A1 * | 5/2003 | Klasco | H04R 7/045 381/152 |
| 2003/0133586 | A1 | 7/2003 | Ko | |
| 2010/0111351 | A1 | 5/2010 | Berkhoff | |
| 2013/0259270 | A1 | 10/2013 | Zhou | |
| 2014/0355813 | A1 | 12/2014 | Huang | |
| 2018/0054503 | A1 | 2/2018 | Park | |

FOREIGN PATENT DOCUMENTS

| | | | |
|---|---|---|---|
| CN | 202131685 | U | 2/2012 |
| CN | 102708853 | A | 10/2012 |
| CN | 202663535 | U | 1/2013 |
| CN | 106170116 | A | 11/2016 |
| CN | 107295446 | A | 10/2017 |
| CN | 107561753 | A | 1/2018 |
| CN | 108156562 | A | 6/2018 |
| CN | 108271103 | A | 7/2018 |
| CN | 108370245 | A | 8/2018 |
| CN | 108462917 | A | 8/2018 |
| CN | 108495244 | A | 9/2018 |
| CN | 108616797 | A | 10/2018 |
| CN | 108833638 | A | 11/2018 |
| CN | 208110252 | U | 11/2018 |
| CN | 208273238 | U | 12/2018 |
| CN | 208273239 | U | 12/2018 |
| CN | 109218943 | A | 1/2019 |
| CN | 109256070 | A | 1/2019 |
| CN | 109326236 | A | 2/2019 |
| CN | 109391889 | A | 2/2019 |
| DE | 10326761 | A1 | 1/2005 |
| EP | 1480489 | A2 | 8/2018 |
| JP | 2000236595 | A | 8/2000 |
| JP | 2002090887 | A | 3/2002 |
| JP | 2006121325 | A | 5/2006 |
| JP | 2014127843 | A | 7/2014 |
| TW | 201513678 | A | 4/2015 |
| WO | WO2017039944 | A1 | 3/2017 |

OTHER PUBLICATIONS

ISR of PCTCN2019123315.
ISR of PCTCN2019123325.
ISR of PCTCN2019123332.
ISR of PCTCN2020096671.
First Office Action of the priority application CN201910523147.1.
"Investigation of the internal subharmonic resonances in Faraday", Acta Acustica, vol. 30, No. 1, Jan. 2005, pp. 47-54.
Extended European Search Report of the parallel application EP20825754.3.
NPL: "Tech Note; Understanding Exciters—Principles and Applications", Apr. 18, 2014, pp. 1-8, XP055273098, Retrieved from the Internet: URL: http://www.daytonaudio.com/media/resources/understanding-and-using-dayton-audio-exciters.pdf.

* cited by examiner

DISPLAY APPARATUS AND ELECTROMAGNETIC ACTUATOR

CROSS-REFERENCE TO RELATED APPLICATION

This application is a continuation of International Application No. PCT/CN2020/096671, filed on Jun. 17, 2020, which claims priority to Chinese Patent Application No. 201910523147.1, filed on Jun. 17, 2019 and entitled "DISPLAY APPARATUS AND ELECTROMAGNETIC ACTUATOR", which are hereby incorporated by reference in their entireties.

TECHNICAL FIELD

Embodiments of the present disclosure relate to electronic technology, and in particular, to a display apparatus and an electromagnetic actuator.

BACKGROUND

With the continuous development of electronic technology and the continuous growth in customer demands, electronic device is developing towards large size, thin thickness and light weight. An electronic device, such as mobile phone, tablet computer, television, or the like, needs to equip with loudspeakers and other sound-emitting apparatus inside, meanwhile ensuring the device keep light and thin. Due to the limitation of the internal space of the electronic device, an installation space left for the loudspeakers is small, so that the loudspeakers installed in the electronic device usually only meets the ordinary play function, and cannot achieve more sound effects such as subwoofer and so on, in other words, resulting in poor play performance.

SUMMARY

Embodiments of the present disclosure provide a display apparatus and an electromagnetic actuator, which allows for better discrimination of the sound channels in the display apparatus when the display apparatus generate sounds with the electromagnetic actuators of different sound channels, thereby improving the user experience of an electronic device with the display apparatus and the electromagnetic actuator.

An embodiment of the present disclosure provides a display apparatus, including:

a display structure, a sound-emitting substrate, at least one electromagnetic actuator and a stabilizer;

where one side of the sound-emitting substrate is attached to the display structure, and the at least one electromagnetic actuator is fixedly attached to the other side of the sound-emitting substrate through the stabilizer; the stabilizer includes: a bracket and a plurality of flexible support feet extending away from the bracket, where the bracket is configured to receive a first electromagnetic actuator among the at least one electromagnetic actuator, and the plurality of flexible support feet are configured to keep the first electromagnetic actuator stable.

Secondly, an embodiment of the present disclosure provides an electromagnetic actuator including a stabilizer, where the stabilizer includes a bracket and a plurality of flexible support feet extending away from the bracket, where the bracket is configured to receive the electromagnetic actuator, and the plurality of flexible support feet are configured to keep the electromagnetic actuator stable.

BRIEF DESCRIPTION OF DRAWINGS

To describe the technical solutions in embodiments of the present disclosure or in the related art more clearly, the following briefly introduces the accompanying figures for describing the embodiments or the related art. Apparently, the accompanying figures in the following description illustrate merely some embodiments of the present disclosure, and persons of ordinary skill in the art may still obtain other figures from these accompanying figures without creative effort.

DESCRIPTION OF EMBODIMENTS

Figure 1:
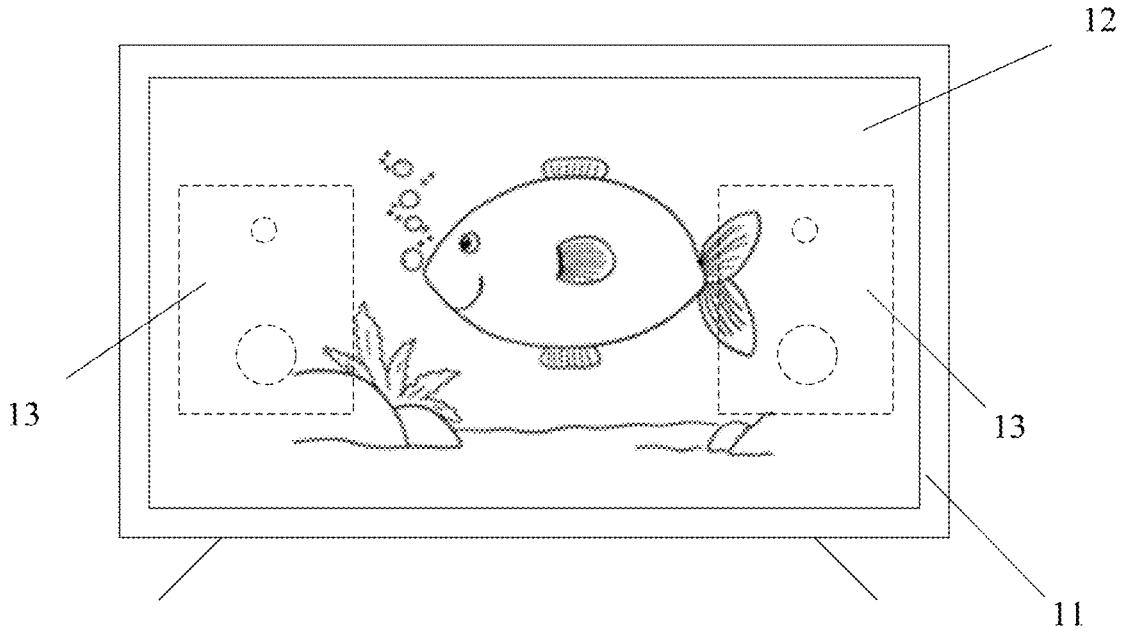
FIG. 1 is a schematic structural diagram for illustrating an electronic device with loudspeakers.

To make the present disclosure and the scope of the present disclosure convenient for persons of ordinary skill in the art to understand, the following clearly and comprehensively describes exemplary embodiments. In order to fully understand the embodiments of the present disclosure, many specific details are described, such as examples of specific components, specific devices and specific methods. Apparently, persons of ordinary skill in the art understand that the discussed exemplary embodiments can be implemented in many different forms without relying on specific details, and that should not be construed as limiting the scope of the present disclosure. In some exemplary embodiments, well-known processes, well-known device structures, and well-known technologies are not described in detail.

The terms herein are for the purpose of describing particular embodiments only, and are not intended to limit the present application. The singular forms "a" and "the" used herein are also intended to include the plurality forms unless indicated otherwise. The terms "including", "comprising" and "having" or any other variations thereof are intended to cover non-exclusive inclusions. For example, a process, method, system, product, or device that includes a series of steps or units is not limited to the listed steps or units, but optionally includes steps or units not listed, or optionally includes other steps or units which are inherent to these processes, methods, products, or device. Unless an order of execution is specified explicitly, the method steps, processes, and operations described herein should not be interpreted as having to be performed in the particular order discussed or illustrated. It should also be understood that additional steps or alternative steps may be employed.

Although the terms first, second, third, or the like may be used herein to describe various elements, components, areas, layers and/or sections, these elements, components, areas, layers and/or sections should not be limited by these terms. These terms can only be used to distinguish one element, component, area, layer or section from another element, component, area, layer or section. Unless the context clearly dictates, terms such as "first", "second", and other numbers used herein do not imply a sequence or order. Therefore, without departing from the exemplary embodiments, the first element, first component, first area, first layer or first section discussed below may be referred to as the second element, second component, second area, second layer or second section.

For convenience, spatially relative terms may be used herein, such as "inner", "outer", "below", "beneath", "lower", "above", "upper", etc. It is used to describe the relationship between an element or feature and another element or feature shown in the figure. In addition to the orientation depicted in the figure, spatial relative terms may also be intended to cover different orientations of the device in use or operation. For example, if the apparatus in the figures is turned over, elements described as being "below" or "beneath" other elements or features would then be redirected as being "above" the other elements or features. Thus, the exemplary term "below" can include both relative orientations of up and down. The device may be oriented in other ways (rotate 90 degrees or other directions), thereby explaining the relative spatial terms used herein.

In the related art, an electronic device may use "sound-emitting technology for flat-panel devices", that is, an electromagnetic actuator is placed behind a display screen, which cause the display screen to make sound using a wave generated based on modal resonance driven by the electromagnetic actuator. In other words, the display screen in the electronic device can be used for display and furthermore it can replace a loudspeaker to perform sound-emitting. Therefore, there is no need to leave an installation position for the loudspeaker in the electronic device, making the design of the electronic device lighter and thinner.

However, with the "sound-emitting technology for flat-panel devices", even if the display screen generates sound driven by multiple electromagnetic actuators of different sound channels, users cannot clearly distinguish the sound channel of the display screen, resulting in that the discrimination of different sound channels is poor when the display screen generate sound, which in turn affects user experience of the electronic device.

FIG. 1 is a schematic structural diagram of an electronic device with loudspeakers, a television is taken as an example of the electronic device. As shown in FIG. 1, a television 11 includes a display screen 12 and loudspeakers 13, where the loudspeakers 13 are arranged behind the display screen 12 inside the television 11. The loudspeakers 13 are generally set on left and right sides of a direction in which the user views the display screen 12, and provide sounds from left and right channels.

Although with the continuous development of electronic technology, more and more key components in electronic devices such as display screens, basic frames, or the like, can be made with a thinner thickness, which can reduce the overall thickness of the electronic devices, but with the demands for the electronic devices gradually towards the direction of thinness and lightness, in the display apparatus 11 shown in FIG. 1, in addition of providing some apparatus for display, the space reserved for the loudspeakers 13 is becoming smaller and smaller. In order to make a television thinner and lighter, television manufacturers can only reduce the functions such as subwoofer of the loudspeakers 13 to reduce the space occupied by the loudspeakers 13 in the television 11, resulting in that the loudspeakers 13 installed in the television 11 can only meet the ordinary play function and cannot achieve more sound effects, which reduces the play performance of the loudspeakers 13.

Figure 2:
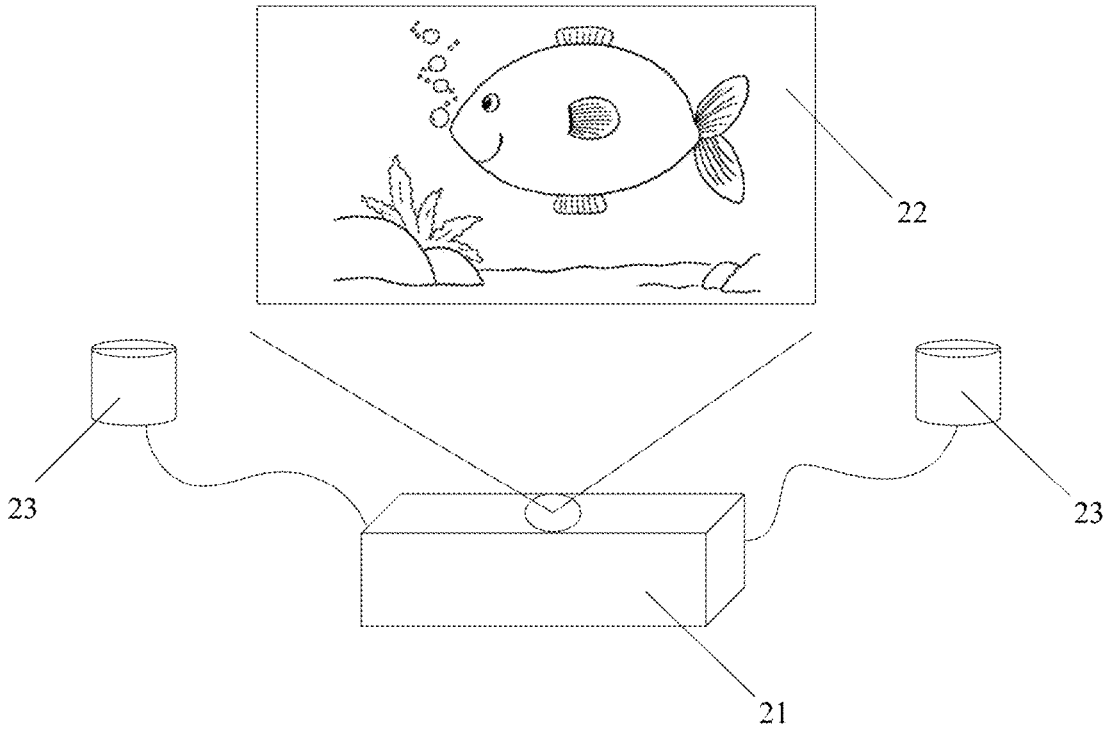
FIG. 2 is a schematic structural diagram for illustrating another electronic device with loudspeakers.

In order to have better audio and video effects, an electronic device such as a laser projection television is usually provided with a separate projection screen and provided with a separate sound box as loudspeaker. FIG. 2 is a schematic structural diagram of another electronic device with loudspeakers, the electronic device takes a laser projection television as an example. As shown in FIG. 2, a laser projection television 21 not only can project a laser beam onto a display screen 22 for the user to view a video screen, but also can provide a sound signal to an external loudspeakers 23 connected thereto to make the loudspeakers 23 play audio. As shown in FIG. 2, since the speaker 23 needs to be set independently, the speaker 23 can achieve better sound effects by having a large volume, and accordingly, the speaker 23 of the electronic device needs to occupy more external space.

In the electronic devices shown in FIGS. 1 and 2, in addition to the location limitations of the loudspeakers, the sound played by both the loudspeakers installed in the electronic device and the external loudspeakers comes from outside of the display screen, leading to a lack of good audio-visual play effect.

Figure 3:
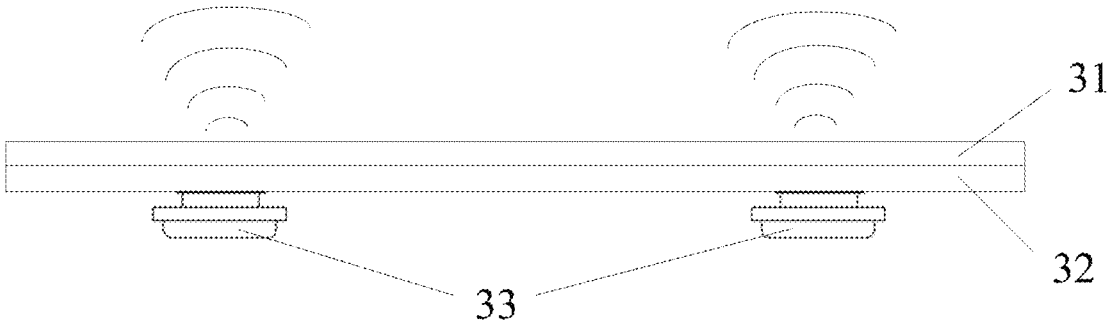
FIG. 3 is a schematic diagram of a sectional view of a display apparatus.
Figure 4:
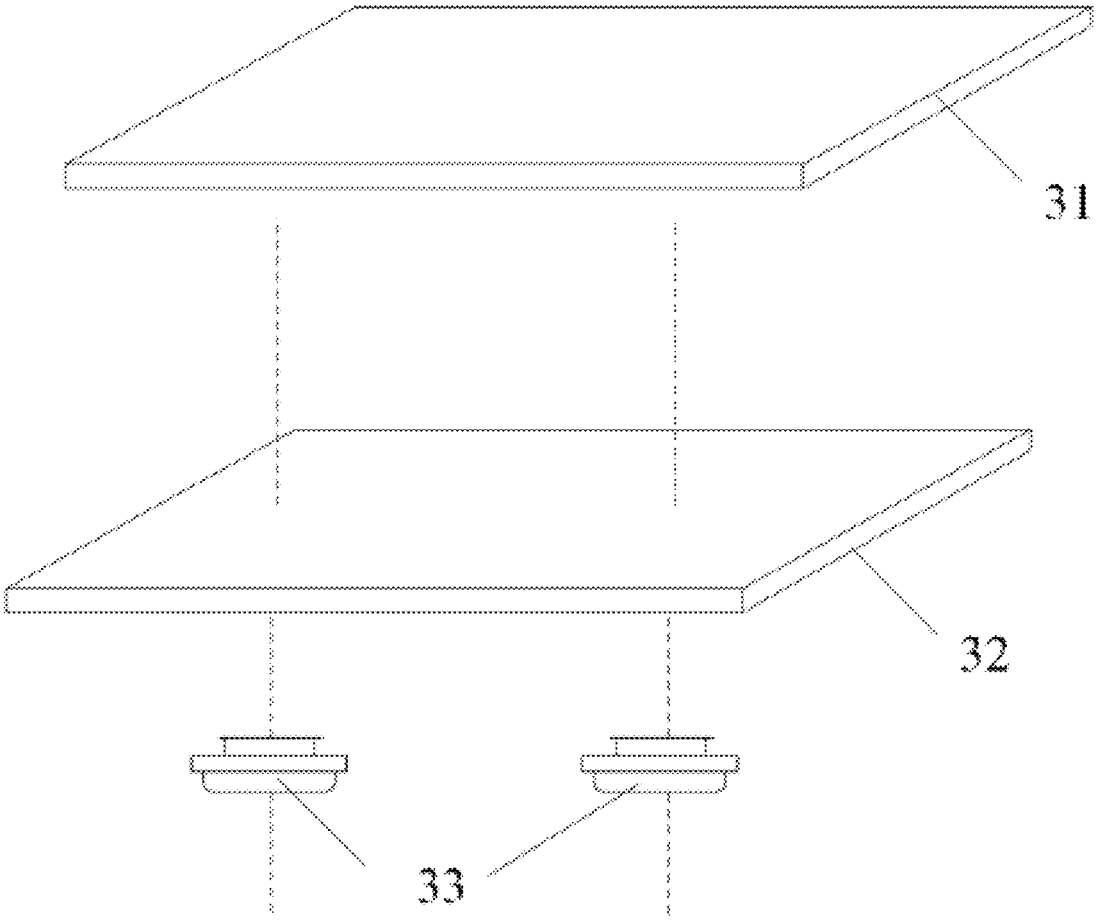
FIG. 4 is a schematic diagram of an exploded structure of a display apparatus.

Therefore, in related art, a "Sound on Display" is applied to the electronic devices. For example, referring to FIGS. 3 and 4, FIG. 3 is a schematic diagram of a sectional view of a display apparatus; and FIG. 4 is a schematic diagram of an exploded view of a display apparatus. The display apparatus includes: an optical film 31, a sound-emitting substrate 32 and an electromagnetic actuator 33. The optical film 31 is configured to receive and display video or image content; the sound-emitting substrate 32 emits sound using a wave generated based on modal resonance driven by the electromagnetic actuator 33. That is, the display apparatus in the electronic device can be used for both display and furthermore emit sound replacing the function of a loudspeaker. Thus, there is no need to leave an installation position for the loudspeaker in the electronic device, and the user does not need to externally connect a loudspeaker, making the design of the electronic device lighter and thinner. Meanwhile, since an area of the sound-emitting substrate 32 can be at most set to be equal to an area of the optical film 31, and the larger the area of the sound-emitting substrate, the better the sound effects such as subwoofer and so on, which make the display apparatus have a better play performance.

Figure 5:
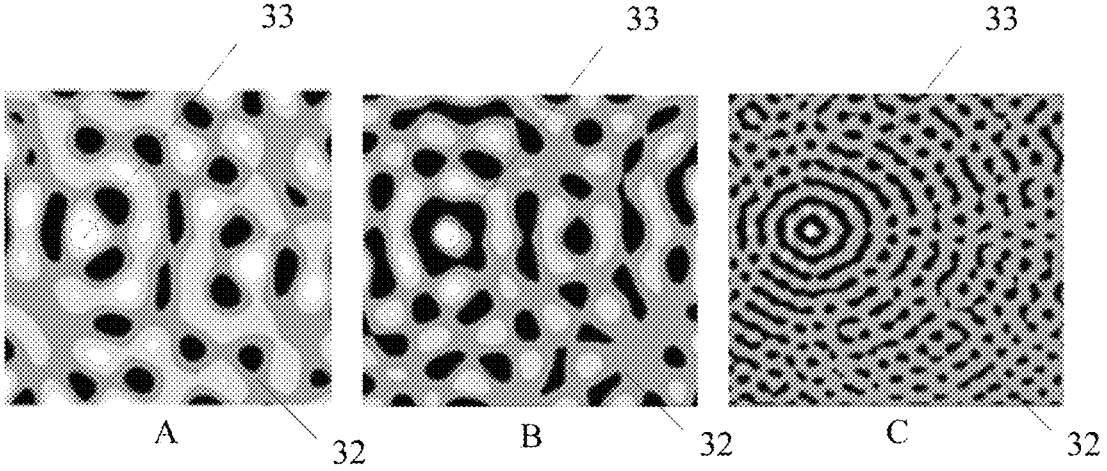
FIG. 5 is a schematic diagram of an amplitude distribution of a wave generated by a display apparatus with an electromagnetic actuator.

However, in the display apparatus shown in FIGS. 3 and 4, since the sound-emitting substrate 32 is set integrally, no matter how many electromagnetic actuators 33 are provided, each electromagnetic actuator 33 works on the same sound-emitting substrate 32 to make the sound-emitting substrate 32 emit sound using the wave generated based on modal resonance. FIG. 5 is a schematic diagram of an amplitude distribution of a wave generated from a display apparatus driven by an electromagnetic actuator. Referring to FIG. 5, the schematic diagram of the amplitude of the wave in the sound-emitting substrate 32 will be described as an example. The sound-emitting substrate 32 generates a wave driven by the electromagnetic actuators 33. The wave transmits around a center where the electromagnetic actuators 33 and the sound-emitting substrate 32 are bonded, and covers the entire sound-emitting substrate 32. The darker the color of the sound-emitting substrate 32 in this figure, the greater the amplitude of the wave at the position toward the upward side of the display apparatus; the lighter the color in this figure, the lower the amplitude of the wave at the position toward the downward side of the display apparatus.

In FIG. 5, a frequency of wave A is 200 Hz, a frequency of wave B is 1000 Hz, and a frequency of wave is 10000 Hz. It can be seen that no matter how the frequency of the wave changes, an amplitude of the wave in all directions are not attenuated much when it transmits in the sound-emitting substrate. Even at the rightmost position away from the electromagnetic actuator 33 in this figure, the amplitude of the wave and the amplitude near the electromagnetic actuator 33 are basically the same. That is, the amplitude distribution of the wave, which generated from the sound-emitting substrate 32 under the control of the electromagnetic actuator 33, at all positions is relatively uniform when the wave transmits in the sound-emitting substrate 32, causing the sound-emitting substrate 32 as a whole emit a sound with a similar strength. When the user hears the sound emitted from the display apparatus, the intuitive feeling is that all positions of the entire screen are emitting similar sounds, and it seems impossible to distinguish sound channels corresponding to different electromagnetic actuators, resulting in poor discrimination of different sound channels in the sound-emitting process of the display apparatus, which in turn affects the user experience of the electronic device.

Therefore, the present disclosure provides a display apparatus and an electromagnetic actuator. When the wave generated from the electromagnetic actuator transmitting in the sound-emitting substrate, the amplitude attenuations in different directions are different, thereby allowing for better discrimination of the sound channels in the display apparatus when the display apparatus generate sounds with the electromagnetic actuator of different sound channels, furthermore improving the user experience of the electronic device with the display apparatus and the electromagnetic actuator.

The technical solutions of the present disclosure will be discussed in detail hereinafter with specific embodiments. The following specific embodiments can be combined with each other, and the same or similar concepts or processes are omitted in some embodiments.

Figure 6:
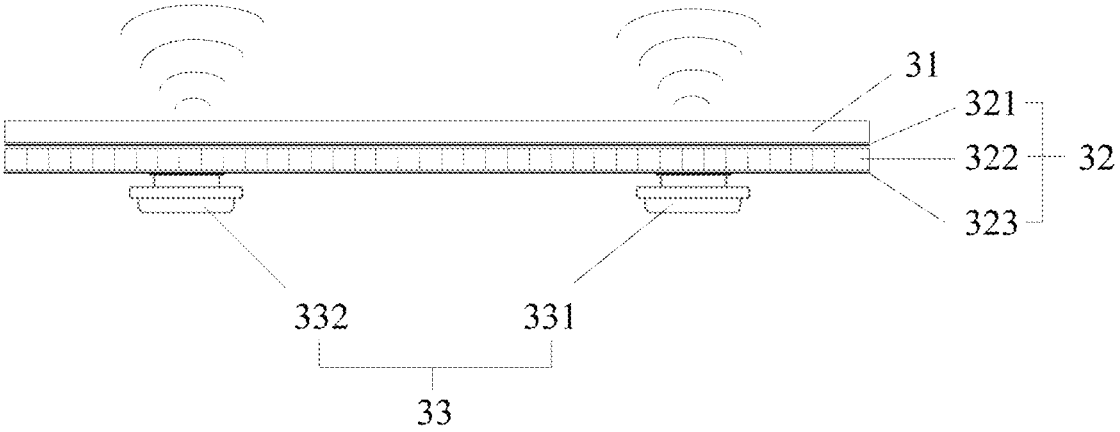
FIG. 6 is a schematic diagram of a sectional view of a display apparatus according to an embodiment of the present disclosure.
Figure 7:
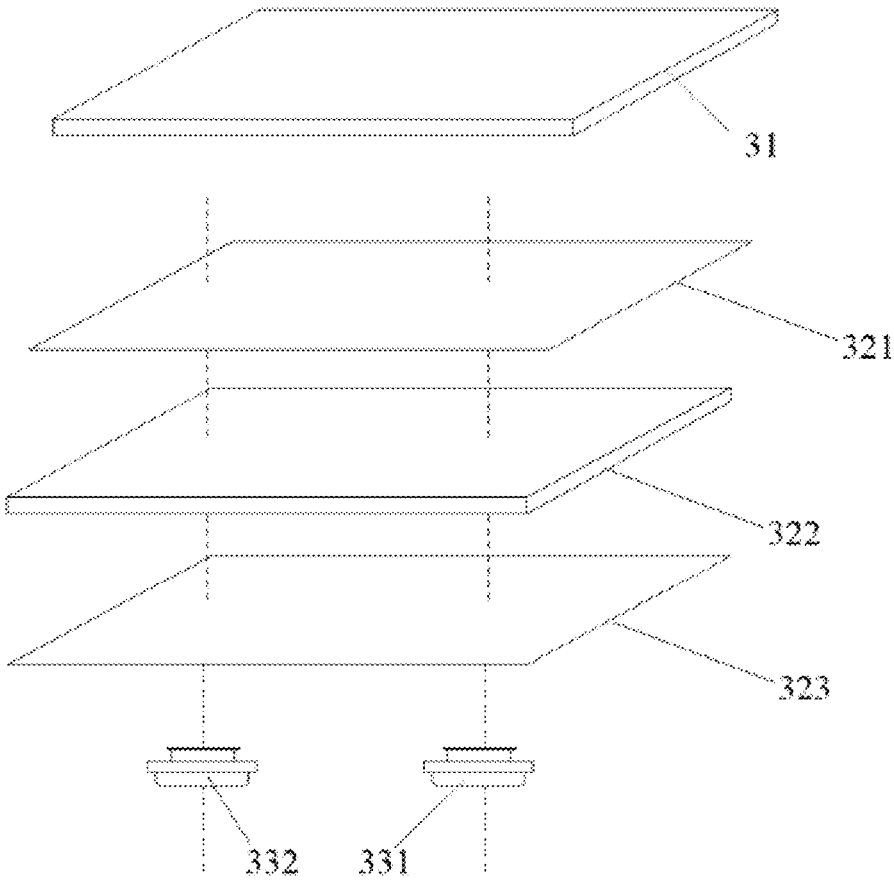
FIG. 7 is a schematic diagram of an exploded view of a display apparatus according to an embodiment of the present disclosure.

FIG. 6 is a schematic diagram of a sectional view of a display apparatus according to an embodiment of the present disclosure; and FIG. 7 is a schematic diagram of an exploded view of a display apparatus according to an embodiment of the present disclosure. In the embodiment shown in FIGS. 6 and 7, a laser TV is used as an example of the display apparatus for description, not for limitation.

The display apparatus according to the embodiment of the present disclosure includes: a display structure 31, a sound-emitting substrate 32 and at least one electromagnetic actuator 33. The display structure 31 is attached to one side of the sound-emitting substrate 32, and the at least one electromagnetic actuator 33 is attached to the other side of the sound-emitting substrate 32. A surface area of the sound-emitting substrate 32 is equal to or smaller than a surface area of the display structure 31.

In a first aspect, the display structure 31 of the display apparatus is configured to realize a display function of the display apparatus, and configured to receive and display an optical signal. The display structure 31 according to the embodiment of the present disclosure includes but not limited to: a liquid crystal display (LCD), an organic light-emitting diode (OLED), a laser projection hard screen, an image display membrane or a touch sensitive membrane, the image display membrane includes but not limited to, a membrane with optical microstructures such as Fresnel film, bar grid film, or microlens array and so on. In the embodiment of the present disclosure, a rectangular structure is used as an example of the display structure for description. In other embodiments, other structures may be used. For example, the display structure may also be an arcuate structure.

In a second aspect, the display structure 31, the sound-emitting substrate 32 and the at least one electromagnetic actuator 33 of the display apparatus work together to realize the sound-emitting function of the display apparatus. In the example shown in FIGS. 6 and 7, the at least one electromagnetic actuator 33 includes two electromagnetic actuators, the two electromagnetic actuators are: a first electromagnetic actuator 331 and a second electromagnetic actuator 332. In other embodiments, more electromagnetic actuators may be included, and the implementation principles are similar, which will omit here. Taking the electromagnetic actuator 331 as an example, the electromagnetic actuator 331 is configured to receive an electrical signal corresponding to the sound to be played, and convert the electrical signal into mechanical vibrations, and then apply the mechanical vibrations to the sound-emitting substrate 32. The sound-emitting substrate 32 generate waves under the action of the mechanical vibration of the electromagnetic actuator 331 according to by modal resonance, and the waves transmit in a 360-degree direction around a bonding position of the electromagnetic actuator 331 and the sound-emitting substrate 32. The sound-emitting substrate 32 and the display structure 31 to which the sound-emitting substrate 32 is attached, under the control of the waves transmitting in the sound-emitting substrate 32, perform reciprocating vibrations in up and down directions of a sectional view of the display apparatus shown in FIG. 6, so as to generate sound.

With respect to the sound-emitting substrate 32 according to the embodiment of the present disclosure, when transmitting the waves in a 360-degree direction range around the bonding position of the electromagnetic actuator 331 and the sound-emitting substrate 32, an amplitude attenuation pattern caused by the sound-emitting substrate 32 with respect to the waves in a first direction is different from an amplitude attenuation pattern caused by the sound-emitting substrate 32 with respect to the waves in a second direction. The attenuation pattern refer to a change mode of amplitude attenuations.

In some embodiments, in order to achieve different amplitude attenuation pattern of the sound-emitting substrate 32 in different directions when transmitting waves, in an embodiment of the present disclosure, the material of the sound-emitting substrate 32 may be configured to cause the performance of the sound-emitting substrate transmit the waves in the first direction is different from the performance of the sound-emitting substrate transmitting the waves in the second direction. That is, the sound-emitting substrate 32 according to the embodiment of the present disclosure has a specific orthonormal and/or zone-strength anisotropy mechanical structure and transmission performance.

In some embodiments, as shown in FIGS. 6 and 7, the sound-emitting substrate according to the embodiment of the present disclosure includes: a first skin 321, a middle layer 322 and a second skin 323. In some embodiments, the first skin 321 is attached to a first side of the middle layer 322 and the second skin 323 is attached to a second side of the middle layer 322 opposite the first side, surface areas of the first skin 321, the middle layer 322 and the second skin 323 are the same; in some other embodiments, the first skin 321 and the second skin 323 may cover at least part of the middle layer 322.

Figure 8:
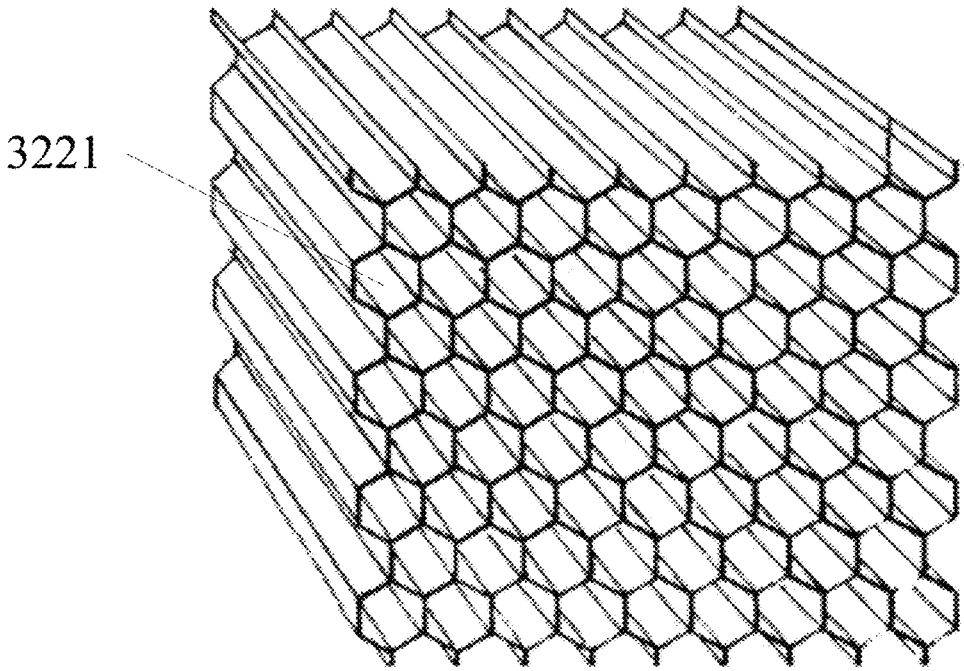
FIG. 8 is a schematic structural diagram of a middle layer of a sound-emitting substrate according to an embodiment of the present disclosure.
Figure 9:
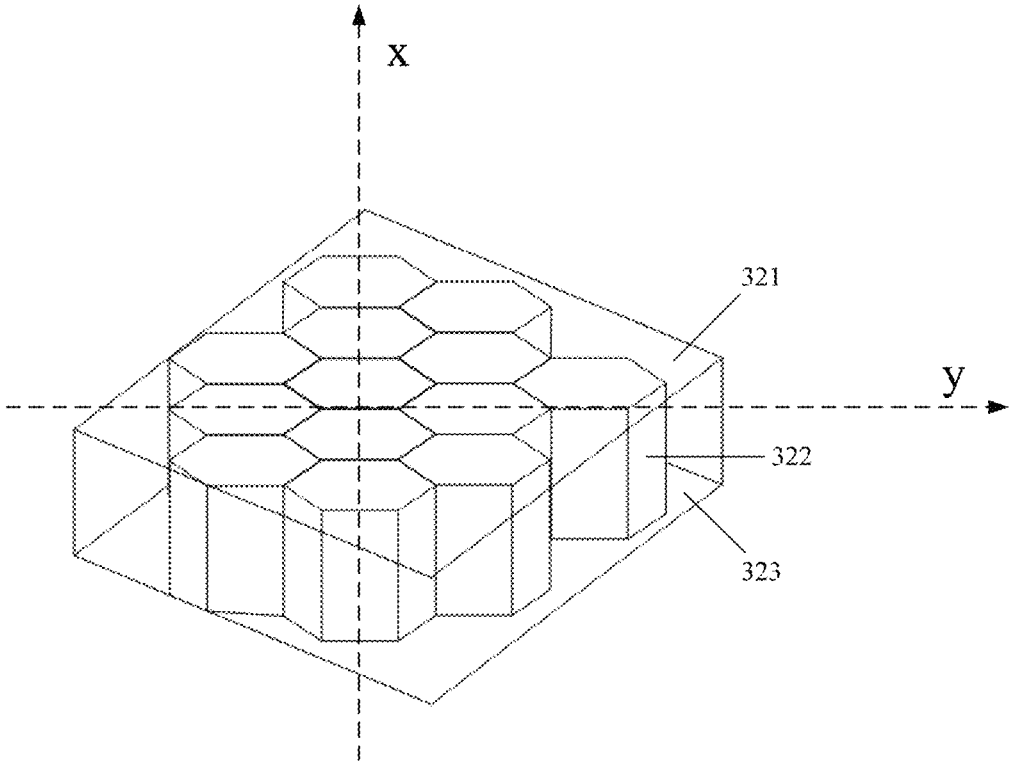
FIG. 9 is a schematic diagram for illustrating an attaching structure for a middle layer, a first skin and a second skin of a sound-emitting substrate according to an embodiment of the present disclosure.
Figure 10:
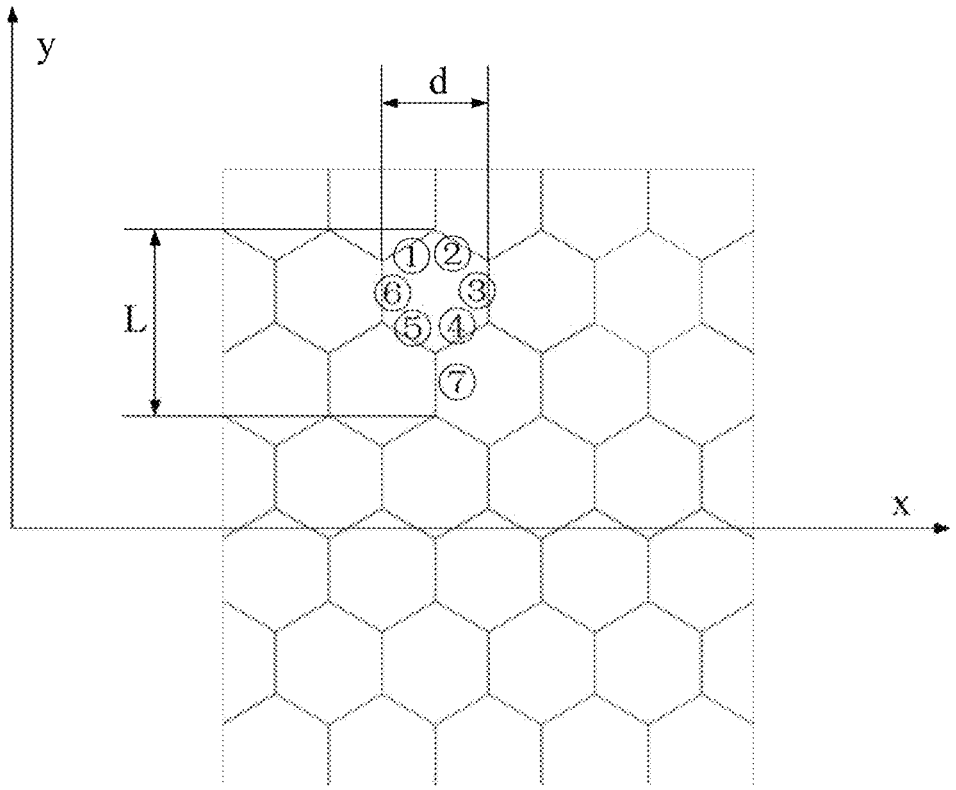
FIG. 10 is a schematic diagram of a sectional view of a middle layer of a sound-emitting substrate according to an embodiment of the present disclosure.

For example, FIG. 8 is a schematic structural diagram of a middle layer of a sound-emitting substrate according to an embodiment of the present disclosure. As shown in FIG. 8, the middle layer of the sound-emitting substrate 32 according to the embodiment of the present disclosure is formed by connecting a plurality of honeycomb cores 3221 presented in a hexagonal shape, except for the honeycomb cores located around the structure, sides corresponding to six sides of each honeycomb core 3221 are respectively connected to corresponding sides of the other six honeycomb cores. In addition, FIG. 9 is a schematic diagram of an attaching structure of a middle layer, a first skin and a second skin of a sound-emitting substrate according to an embodiment of the present disclosure. As shown in FIG. 9, in the sound-emitting substrate, a section of the honeycomb core 3221 included in the middle layer 322 is perpendicular to the first skin 321 and the second skin 323. In some embodiments, the middle layer which includes honeycomb cores is arranged with two parallel sides of a hexagonal honeycomb core wall to parallel to y direction and there is no parallel side of the honeycomb core wall in x direction, so that the sound-emitting substrate has different transmission performance in the x direction and the y direction. By adjusting a stretch ratio of the section of the honeycomb core 3221, the transmission performances in different directions are different. FIG. 10 is a schematic diagram of a sectional view of a middle layer of a sound-emitting substrate according to an embodiment of the present disclosure. As shown in FIG. 10, the stretch ratio of the hexagonal section of the honeycomb core in the x-y directions is d/L. A first direction is set as the y direction in the figure and a second direction is set as the x direction in the figure. Then d is a unit length of each honeycomb core in the x direction when multiple hexagonal honeycomb cores are arranged in order, the unit length d refers to a minimum length unit in the x direction after multiple hexagonal honeycomb cores are arranged in order. That is, multiple hexagonal honeycomb cores are arranged in a pattern consistent with unit length d along the x direction. In FIG. 10, the unit length d is the shortest distance between side ③ and side ⑥ of the hexagon which perpendicular to the x-axis. L is a unit length of each honeycomb core in the y direction when multiple hexagonal honeycomb cores are arranged in order, the unit length L refers to a minimum length unit in the y direction when multiple hexagonal honeycomb cores are arranged in order. That is, multiple hexagonal honeycomb cores are arranged in a pattern consistent with unit length L in the y direction. In FIG. 10, the unit length L is a sum of the distances of sides ①, ⑥, ⑤, and ⑦ of the hexagonal in the y direction.

For a standard hexagon, the stretch ratio in the x-y directions is 0.58:1. In an embodiment of the present disclosure, in order to make the sound-emitting substrate has different transmission performances in different directions, all honeycomb cores in the middle layer of the sound-emitting substrate may be stretched in the x direction of the hexagonal section at a preset stretch ratio, where the preset stretch ratio is less than a preset threshold of 0.58:1.

The stretch ratio d/L being smaller means that the distribution of the hexagonal interface of the honeycomb cores shown in FIG. 10 along parallel walls in the y direction is denser and the rigidity is stronger, so it is easy to transmit the waves through vibrations; it also means that an angle of the hexagonal honeycomb core wall in the x direction is larger and the rigidity is weaker, so it is easy to absorb the transmission of the vibrations of the waves.

Therefore, by setting the stretch ratio of the honeycomb core in the middle layer, the transmission performances of the sound-emitting substrate in the x direction and the y direction are different, the amplitude attenuation pattern in the x direction and the y direction are different when the sound-emitting substrate transmits the wave. In the embodiment shown in FIG. 10, when the stretch ratio in the x-y directions is less than 0.58:1, the transmission performance of the sound-emitting substrate with respect to the wave in the x direction is weaker than that in the y direction, causing an amplitude attenuation degree of the wave in the x direction is larger than that of the wave in the y direction when the sound-emitting substrate provided with the middle layer as shown in FIG. 10 transmits the wave.

Since the first skin and the second skin are attached to both sides of the middle layer, in order to match the transmission performance of the middle layer in x-y directions, in the middle layer according to the embodiment of the present disclosure, fibers of the first skin and the second skin are also made adaptions.

Figure 11:
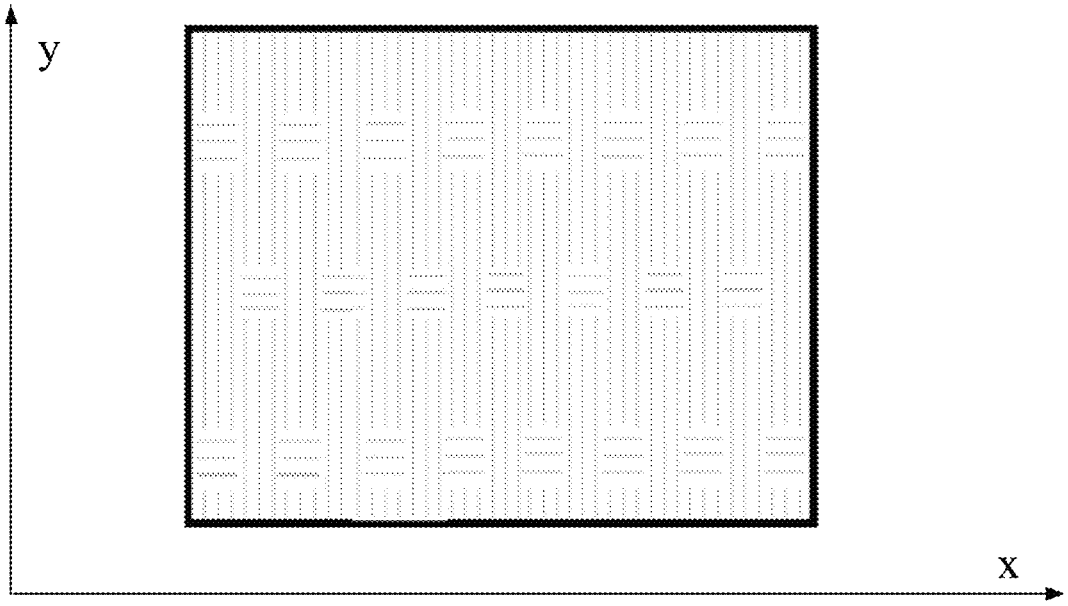
FIG. 11 is a schematic structural diagram of a first skin and a second skin of a sound-emitting substrate according to an embodiment of the present disclosure.

For example, FIG. 11 is a schematic structural diagram of a first skin and a second skin of a sound-emitting substrate according to an embodiment of the present disclosure. As shown in the schematic diagram of the fiber structure on the surface of the skin in FIG. 11, the skin may be the first skin or the second skin in the foregoing embodiment. The skin structure shown in FIG. 11 is a mixed fiber structure in x-y directions, in which a density of fibers parallel to the y direction and perpendicular to the x direction is greater than a density of fibers parallel to the x direction and perpendicular to the y direction.

Alternatively, in another structure of a first skin and a second skin according to an embodiment of the present disclosure, fibers parallel to the x direction and perpendicular to the y direction may not be provided. That is, the first skin and the second skin are unidirectional fiber structures, and the direction of all the fibers is parallel to the y direction and perpendicular to the x direction.

Therefore, the structure of the first skin and the second skin as shown in FIG. 11 can cooperate with the middle layer, so that when the sound-emitting substrate transmits the wave, the amplitude attenuation pattern in the x direction and the y direction are different. In the embodiment shown in FIG. 11, the fibers of the first skin and the second skin have a denser parallel fiber distribution in the y direction, and the rigidity is stronger, so it is easier to transmit the wave through vibrations; and the fibers of the first skin and the second skin has relatively sparser parallel fiber distribution in the x direction, and the rigidity is weaker, so it is not easy to transmit the wave through vibrations. Therefore, for a sound-emitting substrate provided with the middle layer as shown in FIG. 10 and the first skin and the second skin as shown in FIG. 11, when the sound-emitting substrate transmits the wave, an amplitude attenuation degree of the wave in the x direction is larger than that of the wave in the y direction.

In some embodiments, the material of the honeycomb core may be paper, aramid, metal, or other composite materials.

In some embodiments, the materials of the first skin and the second skin include but not limited to glass fiber, carbon fiber, glass-carbon mixed fiber, plastic, lightweight aluminum, and so on.

In some embodiments, the thicknesses of the first skin and the second skin may be the same or different, and the thicknesses of the first skin and the second skin may range from 0.1 mm to 0.5 mm; or the thicknesses of the first skin and the second skin may range from 0.18 mm to 0.36 mm.

In the embodiments shown in FIGS. 6-11, the x-y directions perpendicular to each other is used as an example of the first and second directions for description. In application scenarios, due to the requirement for setting the left and right channels of the electronic device, for the x-y directions described in the present disclosure, in some embodiments, the y direction may be the up and down directions of the electronic device, and the x direction may be the left and right directions of the electronic device.

Figure 12:
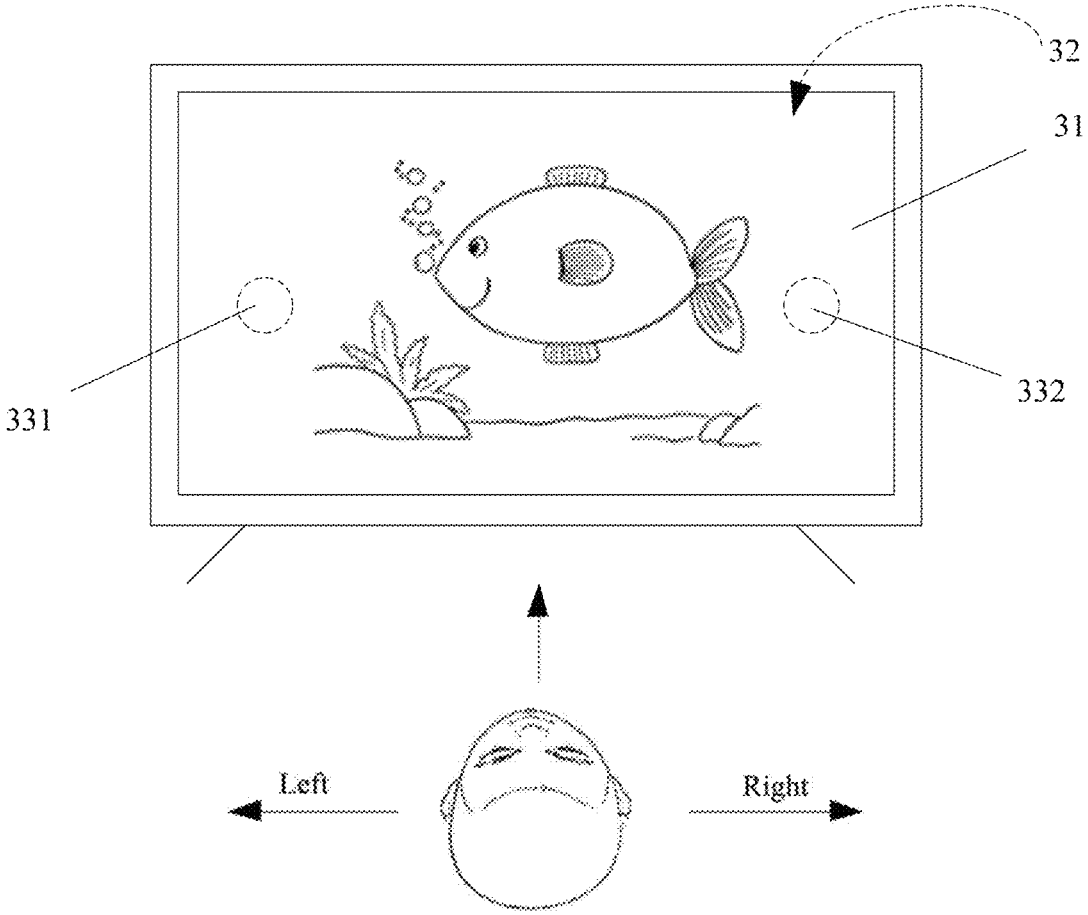
FIG. 12 is a schematic structural diagram of an electronic device with a display apparatus according to an embodiment of the present disclosure.

FIG. 12 is a schematic structural diagram of an electronic device with a display apparatus according to an embodiment of the present disclosure. The electronic device shown in FIG. 12 includes the display apparatus described in any of FIGS. 6-11. A user can view the display content through the display structure 31 of the display apparatus. Meanwhile, the sound played by the electronic device needs to output from the left and right channels. Therefore, with the user's viewing direction as the center, the first electromagnetic actuator 331 is arranged on the left side of the display apparatus at the same height, and the second electromagnetic actuator 332 is arranged on the right side of the display apparatus at the same height.

For the electronic device shown in FIG. 12, when using the display apparatus described in any of FIGS. 6-11, the x direction is the left and right sides of the user's viewing direction in FIG. 12, and the y direction is the up and down sides of the user's viewing direction in FIG. 12.

Figure 13:
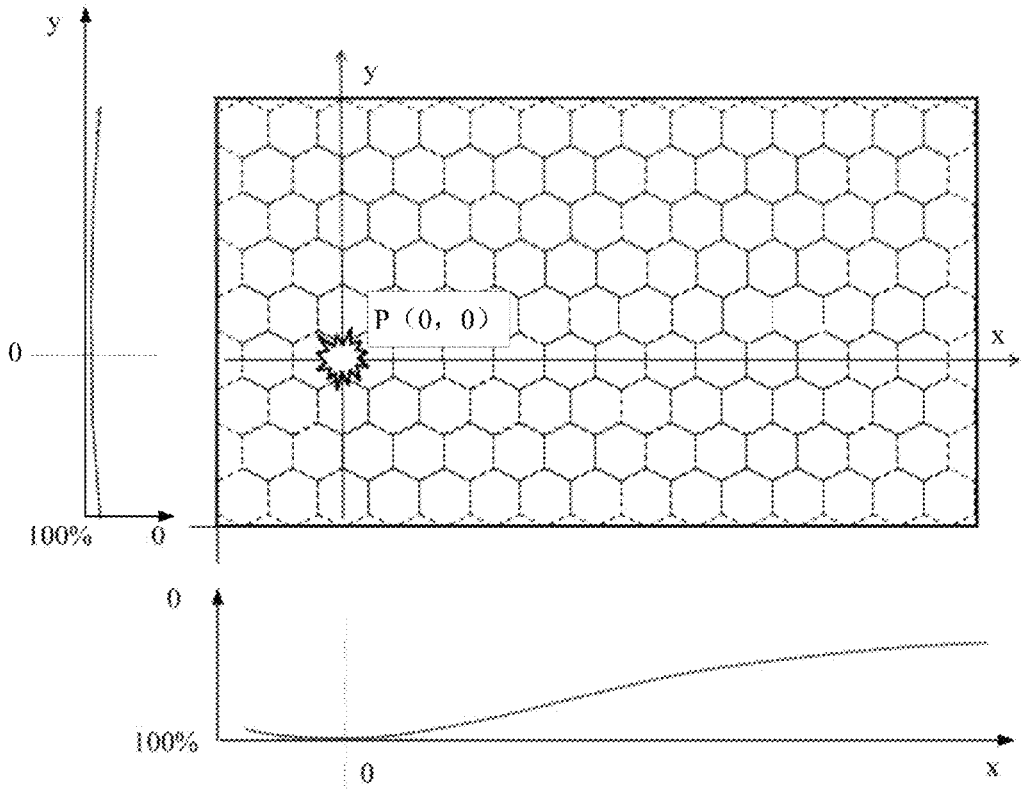
FIG. 13 is a schematic diagram of an amplitude attenuation pattern when a display apparatus transmitting a wave according to an embodiment of the present disclosure.

FIG. 13 is a schematic diagram of an amplitude attenuation pattern when a display apparatus transmitting a wave according to an embodiment of the present disclosure. FIG. 13 shows an amplitude attenuation degrees of the sound-emitting substrate 32 in different directions driven by the first electromagnetic actuator 331 in the screen shown in FIG. 12. In the x-y directions, the point P(0,0) where x=0 and y=0 in the figure is set as a position where the first electromagnetic actuator 331 attached to the sound-emitting substrate 32, then the wave emitted from the sound-emitting substrate 32 under the control of the first electromagnetic actuator 331 transmits around point P as the center, and the amplitude of the sound-emitting substrate at point P is the largest. The amplitude of point P at a certain moment is set as 100%×D, when the wave emits around in a 360-degree direction range taking the point P as the center, the amplitude gradually attenuates from 100%×D to 90%×D, 80%×D . . . . Especially for the x direction and the y direction, when the surface wave emits in these two directions, because the stretch ratio of the honeycomb cores of the middle layer is less than the preset threshold and the density of the first skin and the second skin in the y direction is greater than the density in the x direction, the amplitude attenuation value and attenuation speed of the amplitude at point P in the x direction are greater than those of the amplitude at point P in the y direction.

For the electronic device shown in FIG. 12, the waves driven by the electromagnetic actuator 331 and the electromagnetic actuator 332 and emitted through the sound-emitting substrate have a small attenuation when transmitting in the up and down or vertical direction, and a large attenuation when transmitting in the left and right or horizontal direction. Therefore, because the wave which is obtained from the electromagnetic actuator 331 on the left actuating the sound-emitting substrate 32, attenuates quickly when it transmits to the right, the strength of the wave on the left is greater than the strength of the wave on the right. Meanwhile, the user can hear that the sound from the left side of the screen is greater than the sound from the right side of the screen, so that the sound of the left channel corresponding to the electromagnetic actuator 331 can be distinguished. Similarly, because the wave which is obtained from the electromagnetic actuator 332 on the right actuating the sound-emitting substrate 32, attenuates quickly when it transmits to the left, the strength of the wave on the right is greater than the strength of the wave on the left. Meanwhile, the user can hear that the sound from the right side of the screen is greater than the sound from the left side of the screen, so that the sound of the right channel corresponding to the electromagnetic actuator 332 can be distinguished.

Therefore, in the display apparatus according to the embodiments of the present disclosure, by setting the stretch ratio of honeycomb cores in the middle layer of the sound-emitting substrate and the direction of the fibers of the first skin and the second skin, the sound-emitting substrate can have different amplitude attenuations in different directions when transmitting the wave generated from the electromagnetic actuator, thereby improving the discrimination of the sound channels in the display apparatus when the display apparatus generates sounds with the electromagnetic actuators corresponding to different sound channels, furthermore improving the user experience of the electronic device with the display apparatus.

Based on the foregoing embodiments shown in FIGS. 12 and 13, in order to further increase the amplitude attenuation degree of the wave when the wave transmits in the x direction, so that the user can distinguish between left and right channels easily. In some embodiments of the present disclosure, an isolation area may be arranged in the middle layer of the sound-emitting substrate, so that the first electromagnetic actuator and the second electromagnetic actuator respectively generate and transmit the wave by exciting areas on both sides of the isolation area.

Figure 14:
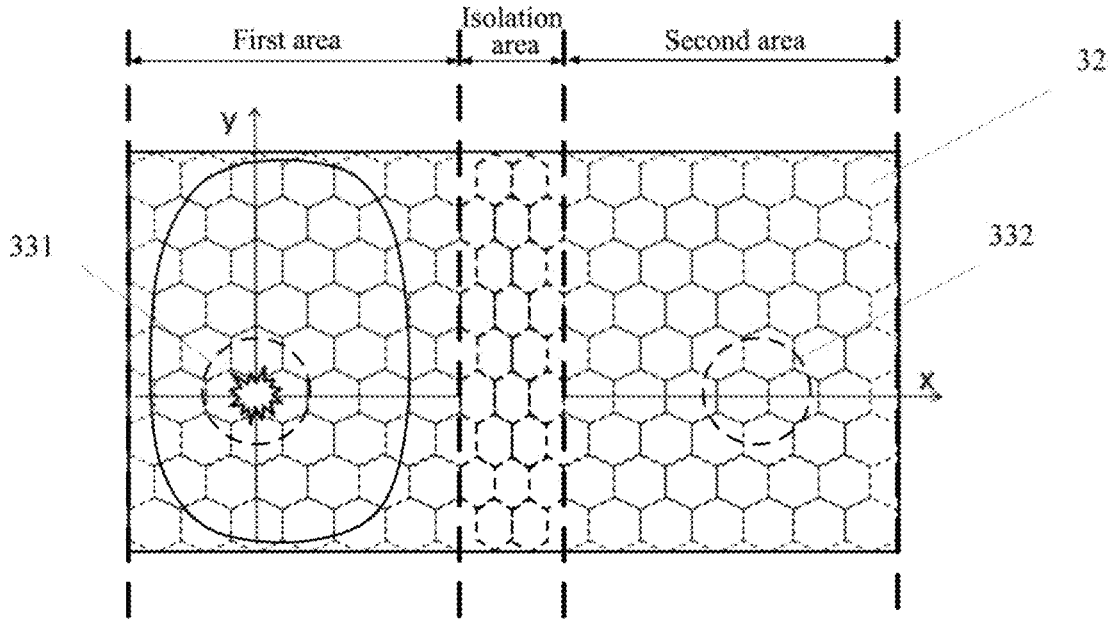
FIG. 14 is a schematic structural diagram of a middle layer of a sound-emitting substrate according to an embodiment of the present disclosure.

FIG. 14 is a schematic structural diagram of a middle layer of a sound-emitting substrate according to an embodiment of the present disclosure. The middle layer of the sound-emitting substrate 32 provided in the embodiment shown in FIG. 14 includes: a first area corresponding to the electromagnetic actuator 331 on the left side, an isolation area, and a second area corresponding to the electromagnetic actuator 332 on the right side. The first area, the second area and the isolation area consist of honeycomb cores in a hexagonal shape. In particular, stretch ratios of honeycomb cores in the first area and the second area are greater than a stretch ratio of honeycomb cores in the isolation area.

According to the above analysis shown in FIG. 10, it can be seen that the smaller the stretch ratio of the honeycomb core in the isolation area of the middle layer, the greater the amplitude attenuation when the sound-emitting substrate transmits the wave in the x direction. For electronic device with the sound-emitting substrate as shown in FIG. 14, in the transmitting process of the wave in the first area of the sound-emitting substrate 32 driven by the electromagnetic actuator 331 on the left to the right, the amplitude of the wave when the wave passes through the isolation area will be more attenuated than that without passing through the isolation area. As a result, the strength of the wave in the first area on the left is significantly greater than the strength of the wave in the second area on the right, which further allows the user to clearly hear the sound from the left side of the screen, but hardly hear the sound from the right side of the screen. That is, the sound of the left channel corresponding to the electromagnetic actuator 331 can be distinguished more clearly. Similarly, in the transmitting process of the wave in the second area of the sound-emitting substrate 32 driven by the electromagnetic actuator 332 on the right to the left, the amplitude of the wave when the wave passes through the isolation area will be attenuated significantly. As a result, the strength of the wave in the second area on the right is significantly greater than the strength of the wave in the first area on the left, which further allows the user to clearly hear the sound from the right side of the screen, but hardly hear the sound from the left side of the screen. That is, the sound of the right channel corresponding to the electromagnetic actuator 332 can be distinguished more clearly.

Figure 15:
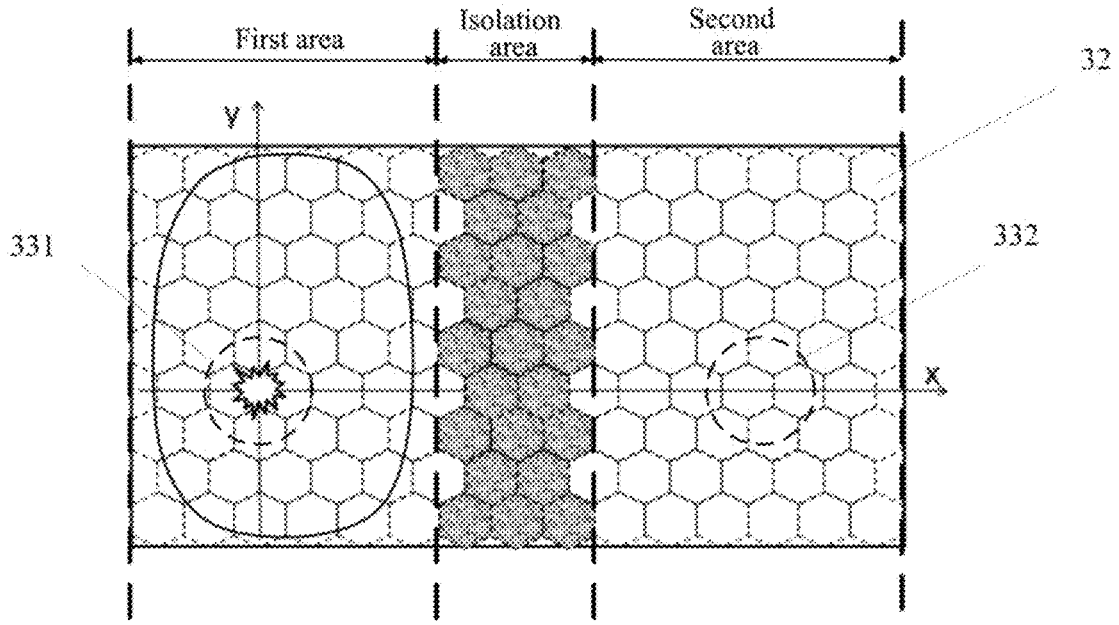
FIG. 15 is a schematic structural diagram of a middle layer of a sound-emitting substrate according to another embodiment of the present disclosure.

FIG. 15 is a schematic structural diagram of a middle layer of a sound-emitting substrate according to another embodiment of the present disclosure. The structure of the sound-emitting substrate 32 in the embodiment shown in FIG. 15 is similar to that of the sound-emitting substrate 32 shown in FIG. 14, except that the honeycomb cores in the isolation area is filled with foam damping material. Similarly, the foam damping material in the isolation area is configured to increase the amplitude attenuation of the sound-emitting substrate when the sound-emitting substrate transmits the wave in the x direction.

In some embodiments, based on any of the foregoing embodiments shown in FIGS. 6 to 15, an embodiment of the present disclosure further provides a stabilizer for supporting the electromagnetic actuator to prevent the electromagnetic actuator from deviating from an optimum working area and reduce twisting motion of the electromagnetic actuator in different directions due to vibration, thereby reducing a distortion of the sound generated by the display apparatus under the control of the electromagnetic actuator.

Figure 16:
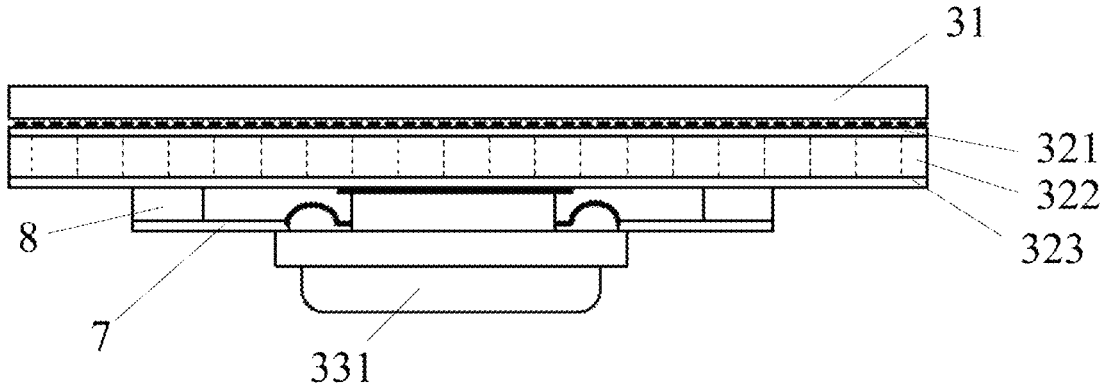
FIG. 16 is a schematic diagram of a sectional view after a stabilizer is installed according to an embodiment of the present disclosure.
Figure 17:
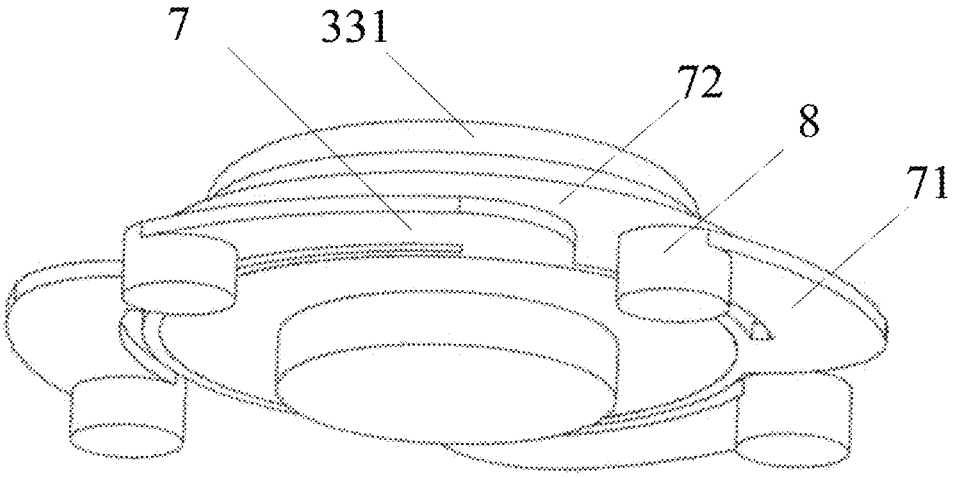
FIG. 17 is a schematic diagram of an installation structure of a stabilizer and an electromagnetic actuator according to an embodiment of the present disclosure.

Referring to FIGS. 16 and 17 hereinafter, FIG. 16 is a schematic diagram of a sectional view after a stabilizer is installed according to an embodiment of the present disclosure, and FIG. 17 is a schematic diagram of an installation structure of a stabilizer and an electromagnetic actuator according to an embodiment of the present disclosure.

As shown in FIG. 17, the stabilizer 7 according to the embodiment of the present disclosure includes: a bracket 72 and a plurality of flexible support feet 71 extending away from the bracket 72. Each foot 71 extends in a direction away from the bracket 72, and the plurality of feet 71 are distributed on a peripheral of a first circle (not shown in FIGS. 17 and 18). In addition, a center of the first circle is located on an axis of the bracket 72 (not shown in FIGS. 17 and 18), and the first circle may be any circle whose center is located on the axis of the bracket 72. The bracket 72 has a first fixed position (not shown in FIGS. 17 and 18), the axis of the first fixed position may be collinear with the axis of the bracket 72, and a vibration output of the electromagnetic actuator 331 passes through the first fixed position of the bracket 72 and abuts against the sound-emitting substrate 32.

In some embodiments, the stabilizer may be referred to as a "spider structure" due to its outwardly extending feet. Taking the electromagnetic actuator 331 as an example, the bracket 72 of the stabilizer has a chamber whose shape matches that of the electromagnetic actuator 331 and is configured to receive and fix the electromagnetic actuator. Then, when the electromagnetic actuator 331 is circular, the shape of the cavity is circular; when the electromagnetic actuator 331 is elliptical, the shape of the cavity is elliptical.

The stabilizer 7 further includes at least one damping block 8, a first damping block among the at least one damping block 8 is disposed at one end of a first foot of the plurality of feet 71. The number of the at least one damping block 8 is less than or equal to the number of the feet 71, and the damping block 8 is fixedly connected to the sound-emitting substrate 32. The plurality of feet 71 may be configured to extend along a peripheral of the stabilizer 7 (that is, the plurality of feet 71 extend away from a center of the stabilizer 7 and around the outer edge of the stabilizer), or the plurality of feet 71 may be configured to extend along a direction away from an axis of the stabilizer 7 (that is, the plurality of feet 71 can be radially extended).

The four feet 71 of the stabilizer 7 as shown in FIG. 17 are respectively fixed to the second skin 323 of the sound-emitting substrate 32 through a damping block 8.

Since the outwardly extending feet 71 and the damping block 8 have a relatively low elastic coefficient, the stabilizer can form a mechanical low-pass filter position stabilizer for the vibration from the flat-panel devices. That is, each support point of the flexible support feet of the position stabilizer receives different random vibrations of the wave, which is being filtered by a mechanical low-pass filter to maintain a stable state, thereby keeping the electromagnetic actuator 331 in the bracket 72 stable.

Since the vibration output of the electromagnetic actuator 331 passes though the stabilizer 7 and abuts against the sound-emitting substrate 32, and the damping block 8 is fixedly connected to the sound-emitting substrate 32, the stabilizer 7 can make the electromagnetic actuator 331 and the sound-emitting substrate 32 relatively stable and ensure that the electromagnetic actuator 331 does not have axial rotation. Furthermore, the structure of the stabilizer 7 makes the stabilizer 7 serve as a mechanical low-pass filter (similar to a damper), so that the vibration is filtered after being transmitted to the feet 71 of the stabilizer 7, and does not affect the vibration of the electromagnetic actuator 331 itself. The electromagnetic actuator 331 includes a drive coil and a magnetic pole component, where the magnetic pole component may generate a magnetic field, and the drive coil may generate a large electric power at a center of the magnetic field to actuate the drive coil. The stabilizer 7 may prevent the drive coil of the electromagnetic actuator from deviating from the center of the magnetic field due to the vibration of the sound-emitting substrate, thereby ensuring that the electromagnetic actuator is in an optimum working state. In addition, the stabilizer 7 may ensure that the electromagnetic actuator does not have axial displacement, which will greatly reduce the distortion of the sound generated from the sound-emitting substrate.

Figure 18:
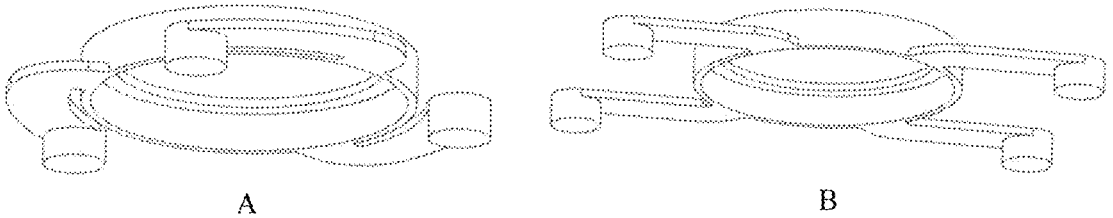
FIG. 18 is a schematic diagram of a stabilizer with other structures according to an embodiment of the present disclosure.

FIG. 18 is a schematic diagram of a stabilizer with other structures according to an embodiment of the present disclosure. FIG. 18 shows several other structures of the stabilizer, in which the stabilizer may have 3 or 4 feet, and the feet can extend around or radially extend away from the bracket. The implementation and principles are similar to the stabilizer shown in FIG. 17, which will omit here.

Based on the foregoing embodiments, a display apparatus according to the present disclosure further includes a support mechanism to support the display apparatus. For example, the support mechanism may be a frame for the display apparatus.

Figure 19:
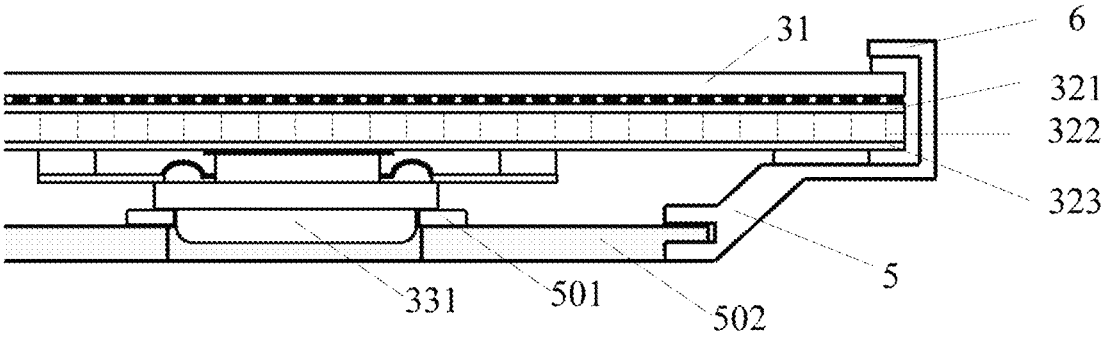
FIG. 19 is a schematic diagram of a sectional view of a support mechanism according to an embodiment of the present disclosure.

FIG. 19 is a schematic diagram of a sectional view of a support mechanism according to an embodiment of the present disclosure. As shown in FIG. 19, edges of the sound-emitting substrate 32 and the display structure 31 are supported by the support mechanism 5 after being wrapped by a suspension structure 6. The suspension structure 6 is configured to receive the sound-emitting substrate 32 and the display structure 31, and the suspension structure 6 may be a foam adhesive tape. The support mechanism 5 is arranged on a side of the sound-emitting substrate 32 close to the electromagnetic actuator, and further includes: a first support structure 501 and a second support structure 502 to jointly support and fix the electromagnetic actuator on a side of the sound-emitting substrate 32.

Figure 20:
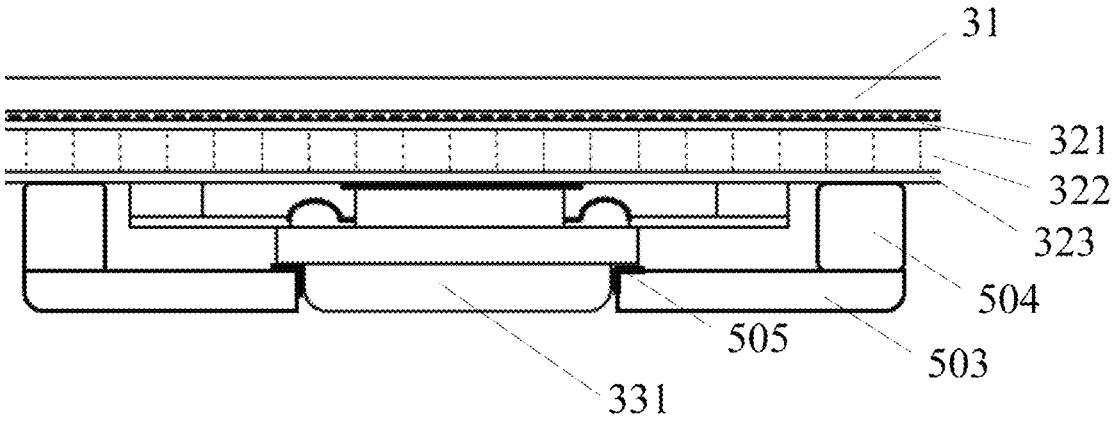
FIG. 20 is a schematic diagram of a sectional view of a support mechanism according to another embodiment of the present disclosure.
Figure 21:
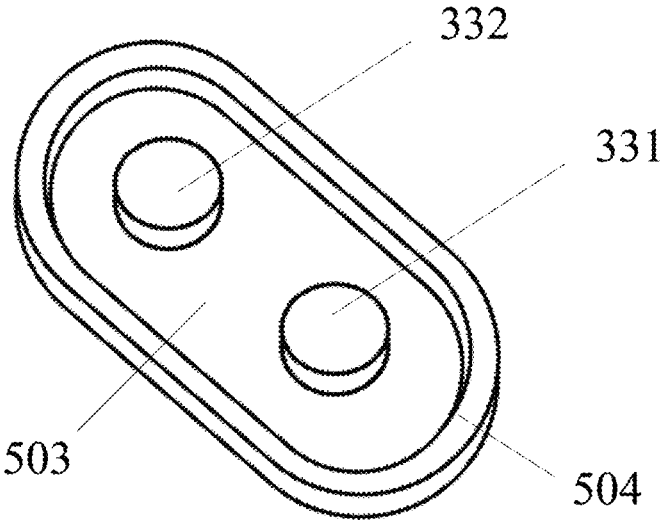
FIG. 21 is a schematic structural diagram of a support mechanism according to another embodiment of the present disclosure.

FIG. 20 is a schematic diagram of a sectional view of a support mechanism according to another embodiment of the present disclosure, and FIG. 21 is a schematic structural diagram of a support mechanism according to another embodiment of the present disclosure. As shown in FIGS. 20 and 21, a support mechanism according to an embodiment of the present disclosure includes: a back cover 503, a cushion member 504 and a seal buffer material 505. The cushion member 504 is a sound damping isolation ring, which can be made from EVA foam material.

Figure 22:
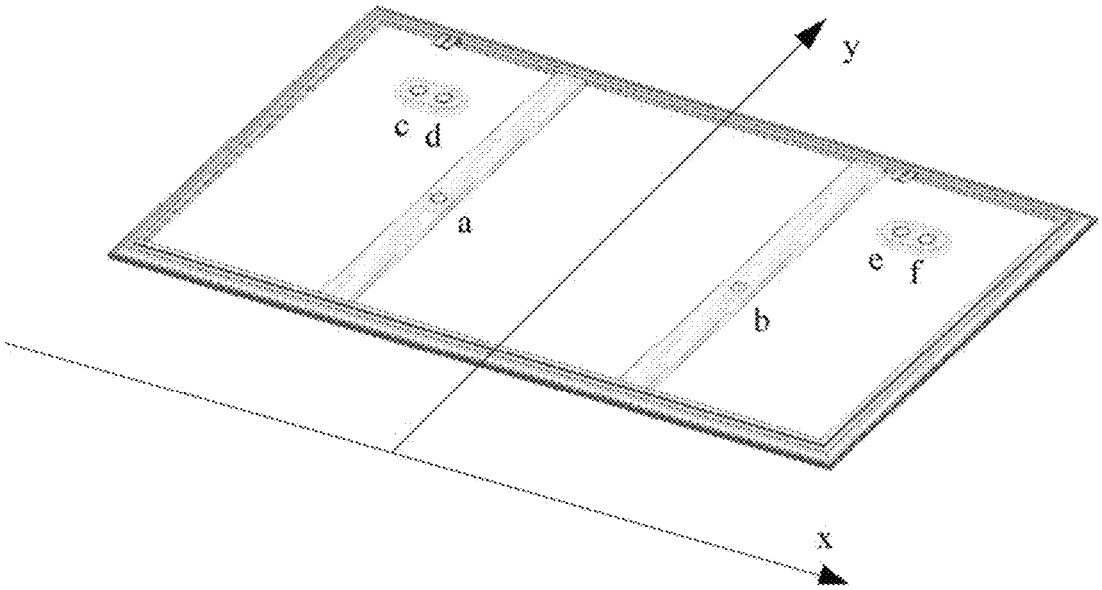
FIG. 22 is a schematic structural diagram of an implementation of a display apparatus according to an embodiment of the present disclosure.
Figure 23:
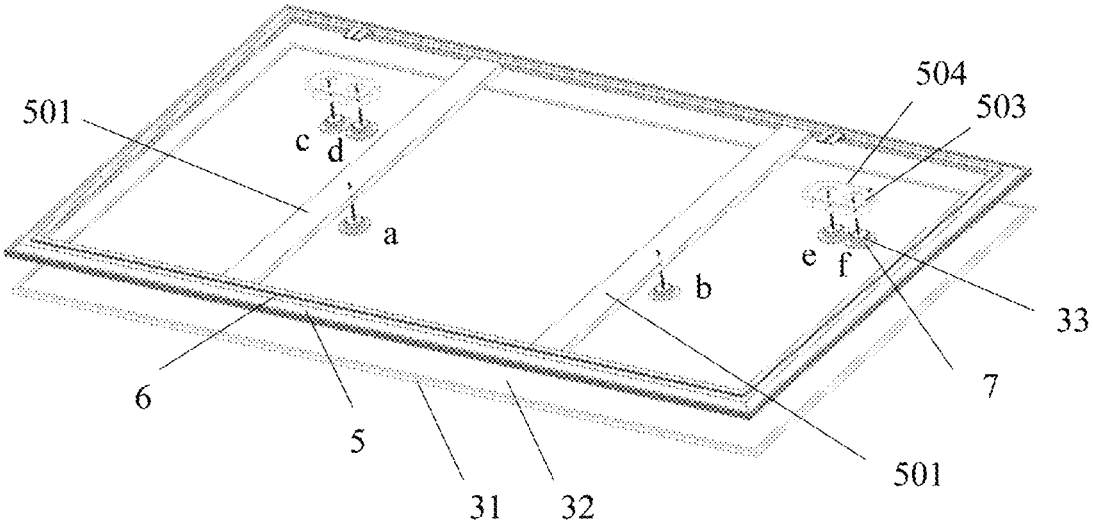
FIG. 23 is a schematic diagram of an exploded view of an implementation of a display apparatus according to an embodiment of the present disclosure.

Based on the foregoing embodiments, an embodiment of the present disclosure further provides an implementation of the display apparatus in engineering applications. Referring to FIGS. 22 and 23, FIG. 22 is a schematic structural diagram of an implementation of a display apparatus according to an embodiment of the present disclosure, and FIG. 23 is a schematic diagram of an exploded view of an implementation of a display apparatus according to an embodiment of the present disclosure. FIG. 23 shows an arrangement of an electromagnetic actuator, a frame structure, and a cushion member in the electronic device with a display apparatus. In the example shown in FIG. 22, the display apparatus is provided with multiple electromagnetic actuators a, b, c, d, e and f with different excitation frequencies according to a play performance requirement that the electronic device needs to meet, so that the waves with different resonance frequencies are generated by different electromagnetic actuators through exciting the sound-emitting substrate, thereby broadening the frequency response of the display apparatus.

The sound-emitting substrate of the display apparatus according to the embodiments of the present disclosure has different transmission performances in the x direction and y direction as shown in the figure, and thus when the sound-emitting substrate transmits the wave, the amplitude attenuation pattern in the x direction and y direction are different. The left channel of the display apparatus in the figure corresponds to the electromagnetic actuators a, c and d in a negative x direction, that is, the electromagnetic actuators a, c and d can be configured to excite the display apparatus to generate waves corresponding to the left channel signal; the right channel of the display apparatus in the figure corresponds to the electromagnetic actuators b, e and f in a positive x direction, that is, the electromagnetic actuators b, e and f can be configured to excite the display apparatus to generate a wave corresponding to the right channel signal. Electromagnetic actuators with different performances are arranged in an oblique line, and the electromagnetic actuators at an upper end of they direction is closer to the edge of the display apparatus. The electromagnetic actuators corresponding to the left channel and the electromagnetic actuators corresponding to the right channel are generally arranged in a "v" shape on the display apparatus.

The structure of the display apparatus in FIG. 22 can refer to FIG. 23, where the display structure 31 and the sound-emitting substrate 32 of the display apparatus are attached to each other, and edges of the two are wrapped by the suspension structure (foam double-sided adhesive tape) 6 and then fixed by the support mechanism 5. Meanwhile, the electromagnetic actuator a and the electromagnetic actuator b are fixed by a first support structure 501, and two ends of the first support structure 501 are arranged between longer sides of the support mechanism 5. A connection manner between the first support structure 501 and the electromagnetic actuators can refer to FIG. 19. The electromagnetic actuators c and d and the electromagnetic actuators e and f are fixed by the back cover 503 and the cushion member 504, and a connection manner between the back cover 503 and the cushion member 504 and the electromagnetic actuators can refer to FIG. 21. In addition, each electromagnetic actuator as shown in the figure is mounted on the sound-emitting substrate 32 through the stabilizer 7.

The embodiment shown in FIGS. 22 and 23 is only exemplary illustration of the display apparatus in an implementation, and installation manner and position setting manner of different numbers of electromagnetic actuators are all within the protection scope of the present disclosure. For example, FIG. 24 is a schematic structural diagram of implementations of display apparatus according to another embodiment of the present disclosure, which shows arrangement and strength direction of the electromagnetic actuator, the frame structure and the cushion member in the electronic device with the display apparatus.

Figure 24:
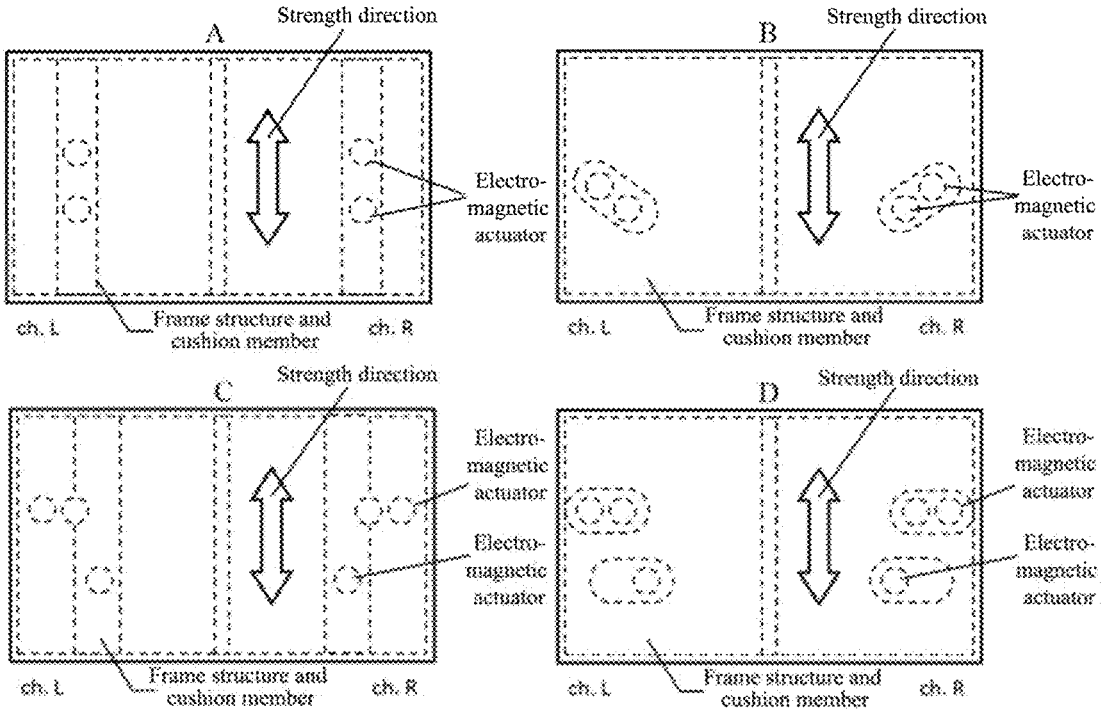
FIG. 24 is a schematic structural diagram of implementations of display apparatus according to another embodiment of the present disclosure.

As shown in FIG. 24, in a schematic diagram A, the left channel and the right channel each correspond to two electromagnetic actuators, and the two electromagnetic actuators are arranged on the same support structure; in a schematic diagram B, the left channel and the right channel each correspond to two electromagnetic actuators, and the two electromagnetic actuators are arranged in the same back cover and cushion member; in a schematic diagram C, the left channel and the right channel each correspond to three electromagnetic actuators, and only one of the three electromagnetic actuators is arranged on the support structure; in a schematic diagram D, the left channel and the right channel each correspond to three electromagnetic actuators, and two of the three electromagnetic actuators are arranged in the same back cover and cushion member, and the other electromagnetic actuator is arranged in a back cover and cushion member.

Figure 25:
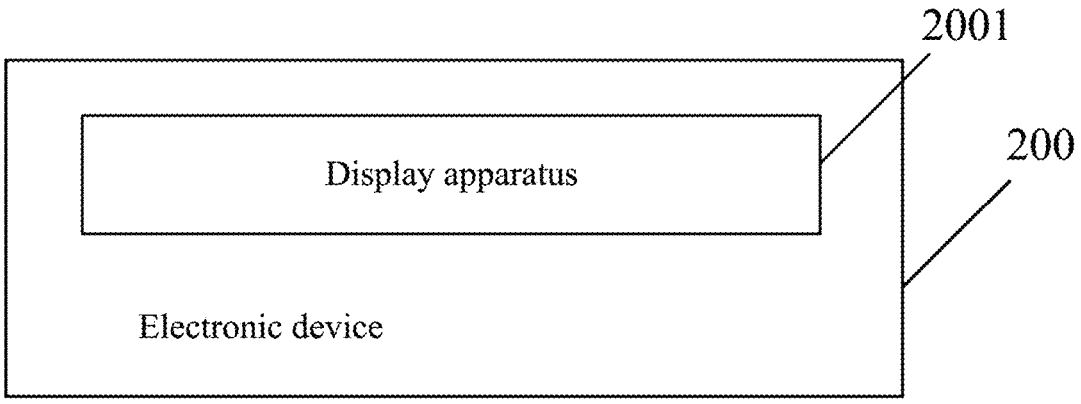
FIG. 25 is a schematic structural diagram of an electronic device according to an embodiment of the present disclosure.

In addition, FIG. 25 is a schematic structural diagram of an electronic device according to an embodiment of the present disclosure. As shown in FIG. 25, the electronic device 20 according to the embodiment of the present disclosure includes: the display apparatus 2001 as described in any of the embodiments of FIGS. 6-24. The electronic device includes but not limited to the following devices: mobile phone, tablet computer, desktop computer, television, and other electrical appliances with display screens, such as washing machine, refrigerator, and so on.

The foregoing embodiments are provided for purposes of illustration and description, and are not intended to be exhaustive or to limit the present disclosure. The individual elements or features of a particular embodiment are generally not limited to that particular embodiment, but may be used or interchanged in selected embodiments if applicable even if they are not specifically shown or described. Variations are also possible in many forms, such variations are not considered to be departing from the present disclosure, and all such modifications fall within the protection scope of the present disclosure.

What is claimed is:

1. A display apparatus, comprising: a display structure, a sound-emitting substrate, at least one electromagnetic actuator and a stabilizer;

wherein one side of the sound-emitting substrate is attached to the display structure, and the at least one electromagnetic actuator is fixedly attached to the other side of the sound-emitting substrate through the stabilizer;

the stabilizer comprises: a bracket and a plurality of flexible support feet extending away from the bracket, wherein the bracket is configured to receive a first electromagnetic actuator among the at least one electromagnetic actuator, and the plurality of flexible support feet are configured to keep the first electromagnetic actuator stable;

at least one damping block, a first damping block among the at least one damping block is disposed at one end of a first foot of the plurality of flexible support feet, the first damping block is fixedly arranged on the sound-emitting substrate.

2. The display apparatus according to claim 1, wherein the plurality of feet are distributed on a peripheral of a first circle whose center is located on an axis of the bracket.

3. The display apparatus according to claim 2, wherein the bracket has a first fixed position whose axis is collinear with the axis of the bracket, and a vibration output of the first electromagnetic actuator passes through the first fixed position of the bracket and abuts against the sound-emitting substrate.

4. The display apparatus according to claim 1, wherein the bracket has a chamber whose shape matches a shape of the first electromagnetic actuator.

5. The display apparatus according to claim 1, wherein the number of the at least one damping block is less than or equal to the number of the plurality of flexible support feet.

6. The display apparatus according to claim 1, wherein the plurality of flexible support feet are configured to extend around or radially extend away from the bracket.

7. The display apparatus according to claim 1, wherein the sound-emitting substrate comprises: a first skin, a second skin and a middle layer, the first skin is attached to a first side of the middle layer and the second skin is attached to a second side of the middle layer opposite the first side.

8. The display apparatus according to claim 7, wherein the middle layer is formed by connecting a plurality of honeycomb cores whose cross section is hexagonal.

9. The display apparatus according to claim 8, wherein the hexagonal section of the honeycomb cores is stretched at a preset stretch ratio which is less than a preset threshold.

10. The display apparatus according to claim 7, wherein structures of the first skin and the second skin are a mixed fiber structure whose density is different in different directions.

11. The display apparatus according to claim 7, wherein thickness of the first skin is different from that of the second skin.

12. The display apparatus according to claim 7, wherein the at least one electromagnetic actuator comprises: the first electromagnetic actuator and a second electromagnetic actuator;

the middle layer comprises: a first area, an isolation area and a second area, wherein the first area and the second area are configured to transmit waves, and the isolation area is configured to attenuate an amplitude of the waves between the first area and the second area;

the first electromagnetic actuator is configured to send a magnetic actuating signal to the first area, and the first area is configured to receive and transmit a wave generated from the magnetic actuating signal to make the sound-emitting substrate and the display structure corresponding to the first area vibrate and emit sound;

the second electromagnetic actuator is configured to send a magnetic actuating signal to the second area, and the second area is configured to receive and transmit a wave generated from the magnetic actuating signal to make the sound-emitting substrate and the display structure corresponding to the second area vibrate and emit sound.

13. The display apparatus according to claim 12, wherein the first area, the second area and the isolation area consist of honeycomb cores in a hexagonal shape, and stretch ratios of honeycomb cores in the first area and the second area are greater than a stretch ratio of honeycomb cores in the isolation area.

14. The display apparatus according to claim 13, wherein the honeycomb cores in the isolation area are filled with foam damping material.

15. The display apparatus according to claim 1, further comprising:

a suspension structure and a support mechanism;

wherein the suspension structure is configured to receive the sound-emitting substrate and the display structure;

the support mechanism is configured to support and cover a space between the at least one electromagnetic actuator and the suspension structure.

16. A display apparatus, comprising: a display structure, a sound-emitting substrate, at least one electromagnetic actuator and a stabilizer;

wherein one side of the sound-emitting substrate is attached to the display structure, and the at least one electromagnetic actuator is fixedly attached to the other side of the sound-emitting substrate through the stabilizer;

the stabilizer comprises: a bracket and a plurality of flexible support feet extending away from the bracket, wherein the bracket is configured to receive a first electromagnetic actuator among the at least one electromagnetic actuator, and the plurality of flexible support feet are configured to keep the first electromagnetic actuator stable;

wherein the sound-emitting substrate comprises: a first skin, a second skin and a middle layer, the first skin is attached to a first side of the middle layer and the second skin is attached to a second side of the middle layer opposite the first side;

wherein the at least one electromagnetic actuator comprises: the first electromagnetic actuator and a second electromagnetic actuator;

the middle layer comprises: a first area, an isolation area and a second area, wherein the first area and the second area are configured to transmit waves, and the isolation area is configured to attenuate an amplitude of the waves between the first area and the second area;

the first electromagnetic actuator is configured to send a magnetic actuating signal to the first area, and the first area is configured to receive and transmit a wave generated from the magnetic actuating signal to make the sound-emitting substrate and the display structure corresponding to the first area vibrate and emit sound;

the second electromagnetic actuator is configured to send a magnetic actuating signal to the second area, and the second area is configured to receive and transmit a wave generated from the magnetic actuating signal to make the sound-emitting substrate and the display structure corresponding to the second area vibrate and emit sound.

17. The display apparatus according to claim 16, wherein the first area, the second area and the isolation area consist of honeycomb cores in a hexagonal shape, and stretch ratios of honeycomb cores in the first area and the second area are greater than a stretch ratio of honeycomb cores in the isolation area.

18. The display apparatus according to claim 17, wherein the honeycomb cores in the isolation area are filled with foam damping material.

19. A display apparatus, comprising: a display structure, a sound-emitting substrate, at least one electromagnetic actuator and a stabilizer;

wherein one side of the sound-emitting substrate is attached to the display structure, and the at least one electromagnetic actuator is fixedly attached to the other side of the sound-emitting substrate through the stabilizer;

the stabilizer comprises: a bracket and a plurality of flexible support feet extending away from the bracket, wherein the bracket is configured to receive a first electromagnetic actuator among the at least one electromagnetic actuator, and the plurality of flexible support feet are configured to keep the first electromagnetic actuator stable;

wherein the display apparatus further comprises:

a suspension structure and a support mechanism;

wherein the suspension structure is configured to receive the sound-emitting substrate and the display structure;

the support mechanism is configured to support and cover a space between the at least one electromagnetic actuator and the suspension structure.

* * * * *